US005493266A

United States Patent [19]

Sasaki et al.

[11] Patent Number: 5,493,266

[45] Date of Patent: Feb. 20, 1996

[54] MULTILAYER POSITIVE TEMPERATURE COEFFICIENT THERMISTOR DEVICE

[76] Inventors: Kiyomi Sasaki; Hideaki Niimi, both c/o Murata Manufacturing Co., Ltd., 26-10, Tenjin 2-chome, Nagaokakyo-shi, Kyoto, Japan

[21] Appl. No.: 228,731

[22] Filed: Apr. 18, 1994

[30] Foreign Application Priority Data

Apr. 16, 1993 [JP] Japan ..... 5-090283

[51] Int. Cl.[6] ..... H01C 7/10

[52] U.S. Cl. ..... 338/22 R; 338/225 D; 338/314; 29/612

[58] Field of Search ..... 338/21, 22 R, 338/225 D, 306, 314, 324, 325; 361/127, 321; 29/25.42, 610, 621, 612; 219/541, 543, 553

[56] References Cited

U.S. PATENT DOCUMENTS

H415 1/1988 Newnham et al. ..... 338/22 R 3,914,727 10/1975 Fabricius ..... 338/22 R 4,486,737 12/1984 Ott ..... 338/22 R 4,766,409 8/1988 Mandai ..... 338/22 R

FOREIGN PATENT DOCUMENTS 3-145920 6/1991 Japan .

*Primary Examiner*—Tu Hoang

[57] ABSTRACT

A plurality of semiconductor substrates having positive resistance-temperature coefficients are bonded to each other through a glass layer to be stacked. First and second terminal electrodes are formed on end surfaces of such a stacked structure respectively. First and second ohmic electrodes are formed on respective major surfaces of each semiconductor substrate, and the first and second ohmic electrodes are connected to the first and second terminal electrodes respectively. The ohmic electrodes contain a metal, other than silver, exhibiting an ohmic property, such as zinc, aluminum, nickel or chromium, for example. The terminal electrodes also contain a metal, other than silver, exhibiting an ohmic property. The terminal electrodes may be provided on surfaces thereof with layers which are made of a metal having excellent solderability.

17 Claims, 3 Drawing Sheets

MULTILAYER POSITIVE TEMPERATURE COEFFICIENT THERMISTOR DEVICE

BACKGROUND OF THE INVENTION

1. Field of the Invention

The present invention relates to a multilayer positive temperature coefficient thermistor device in which a plurality of semiconductor substrates having positive resistance-temperature coefficient are stacked with each other, and more particularly, it relates to improvements in materials of electrodes which are in ohmic contact with the semiconductor substrates and a stacked structure including the plurality of semiconductor substrates.

2. Description of the Background Art

For example, Japanese Patent Application Laying-Open No. 3-145920 (1991) discloses a multilayer positive temperature coefficient thermistor device which is of interest to the present invention. FIG. 3 shows such a multilayer positive temperature coefficient thermistor device 1.

Referring to FIG. 3, the thermistor device 1 comprises a plurality of semiconductor substrates 2. Each semiconductor substrate 2 is obtained by adding a slight amount of a rare earth element such as lanthanum, cerium, yttrium or samarium to a material which is prepared by partially replacing barium forming barium titanate with strontium for attaining a semiconductor state, and firing this material, for example. As shown in FIG. 4, each semiconductor substrate 2 is in the form of a rectangular plate, which is provided with ohmic electrodes 3 and 4 on surfaces thereof. The first ohmic electrode 3 is formed to extend from a first major surface toward a first end surface of the semiconductor substrate 2, while the second ohmic electrode 4 is formed to extend from a second major surface toward a second end surface of the semiconductor substrate 2, thereby providing L-shaped sections respectively. The ohmic electrodes 3 and 4 are mainly made of silver, and contain at least one of bismuth, antimony and zinc, which is added to provide an ohmic property.

In the thermistor device 1 shown in FIG. 3, six semiconductor substrates 2 are stacked with each other. In more concrete terms, directions of the semiconductor substrates 2 as stacked are so selected that those of the ohmic electrodes 3 and 4 extending toward end surfaces of the same sides are in contact with each other. Such a stacked state of the semiconductor substrates 2 is maintained by conductive holders 5 and 6. These conductive holders 5 and 6 are mounted on respective end portions of a stacked structure which is formed by the semiconductor substrates 2, to bring the respective end portions of the semiconductor substrates 2 into pressure contact with each other.

The conductive holders 5 and 6 also serve as external terminals of the thermistor device 1. The first conductive holder 5 comes into electrical contact with the first ohmic electrodes 3 which are formed on the respective semiconductor substrates 2 respectively, while the second conductive holder 6 comes into electrical contact with the second ohmic electrodes 4 which are also formed on the respective semiconductor substrates 2 respectively. Therefore, the six semiconductor substrates 2 are electrically connected in parallel with each other by the conductive holders 5 and 6.

In the aforementioned thermistor device 1, it is possible to change the combined resistance value provided by the overall thermistor device 1 by changing the number of the semiconductor substrates 2.

While each of the semiconductor substrates 2 forming the thermistor device 1 shown in FIG. 3 is provided with the ohmic electrodes 3 and 4 having L-shaped sections as shown in FIG. 4, such a semiconductor substrate 2 may be replaced by a semiconductor substrate 2*a* shown in FIG. 5. This semiconductor substrate 2*a* is provided with ohmic electrodes 3*a* and 4*a* which extend only on respective major surfaces thereof. According to such ohmic electrodes 3*a* and 4*a*, an operation for forming the same is simplified as compared with that for the ohmic electrodes 3 and 4 shown in FIG. 4, while it is possible to improve reliability in electrical connection since no disconnection is caused on edge portions.

However, the aforementioned multilayer positive temperature coefficient thermistor device which is disclosed in Japanese Patent Laying-Open No. 3-145920 (1991) has the following problems to be solved.

First, the silver forming the ohmic electrodes may migrate into the semiconductor substrates during employment of the thermistor device, to cause an electrical short across the first and second ohmic electrodes provided on each semiconductor substrate.

Further, the stacked state of the plurality of semiconductor substrates is maintained by the conductive holders. Thus, it is troublesome to handle the plurality of semiconductor substrates, which are not connected with each other before the conductive holders are mounted on the stacked structure.

SUMMARY OF THE INVENTION

Accordingly, an object of the present invention is to provide a multilayer positive temperature coefficient thermistor device which can avoid the aforementioned problem of migration of silver employed for forming ohmic electrodes.

Another object of the present invention is to provide a multilayer positive temperature coefficient thermistor device which can simplify handling of a plurality of semiconductor substrates in a stacked state.

The multilayer positive temperature coefficient thermistor device according to the present invention comprises a stacked structure including a plurality of semiconductor substrates having positive resistance-temperature coefficients, which are stacked with each other. In this stacked structure, the semiconductor substrates are bonded to each other by glass layers which are formed between adjacent ones thereof. First and second terminal electrodes are formed on end surfaces of the stacked structure, on which end surfaces of the semiconductor substrates are positioned. First and second ohmic electrodes are formed on first and second major surfaces of each semiconductor substrate, to extend toward end portions which are different from each other. The first and second ohmic electrodes are electrically connected to the first and second terminal electrodes respectively.

In the aforementioned thermistor device, the feature of the present invention resides in that the ohmic electrodes contain a metal, other than silver, exhibiting an ohmic property. Thus, it is possible to avoid the problem of migration of silver, thereby preventing an electrical short which can be caused across the first and second ohmic electrodes formed on each semiconductor substrate. In the stacked structure, the plurality of semiconductor substrates are bonded to each other by the glass layers, whereby the plurality of semiconductor substrates are easy to handle in the stacked state. Thus, it is possible to efficiently carry out a step of forming the terminal electrodes in manufacturing of the thermistor device. Further, no components such as the conductive holders are required and hence it is possible to reduce the number of components forming the thermistor device. In addition, bonding by the glass layers enables strong holding of the plurality of semiconductor substrates in a stacked state.

The aforementioned metal, other than silver, exhibiting an ohmic property can be prepared from zinc, aluminum, nickel or chromium, for example. It is preferable that the terminal electrodes also contain a metal, other than silver, exhibiting an ohmic property. In this case, the terminal electrodes may contain a metal which is identical to or different from that contained in the ohmic electrodes.

Each of the terminal electrodes may be formed by a plurality of layers including an underlayer which is in contact with the end surfaces of the semiconductor substrates and an outermost layer which is formed in the exterior of the underlayer to be exposed on the surface. In this case, the underlayer preferably contains a metal, other than silver, exhibiting an ohmic property. On the other hand, the outermost layer preferably contains a metal having excellent solderability, such as silver, tin, solder or a silver alloy, for example. In this case, it is possible to easily solder the terminal electrodes to a circuit board when the multilayer positive temperature coefficient thermistor device is employed as a surface mounting component.

The glass layers for bonding the plurality of semiconductor substrates with each other are preferably formed also between the ohmic electrodes which are opposed to each other between adjacent ones of the semiconductor substrates. Thus, the ohmic electrodes are covered with the glass layers to be advantageously prevented from deterioration in quality such as oxidation, so that it is possible to efficiently maintain the ohmic property provided by the ohmic electrodes.

Further, the ohmic electrodes which are opposed to each other between adjacent ones of the semiconductor substrates are preferably electrically connected with the same terminal electrodes, in order to prevent an electrical short across the adjacent semiconductor substrates.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
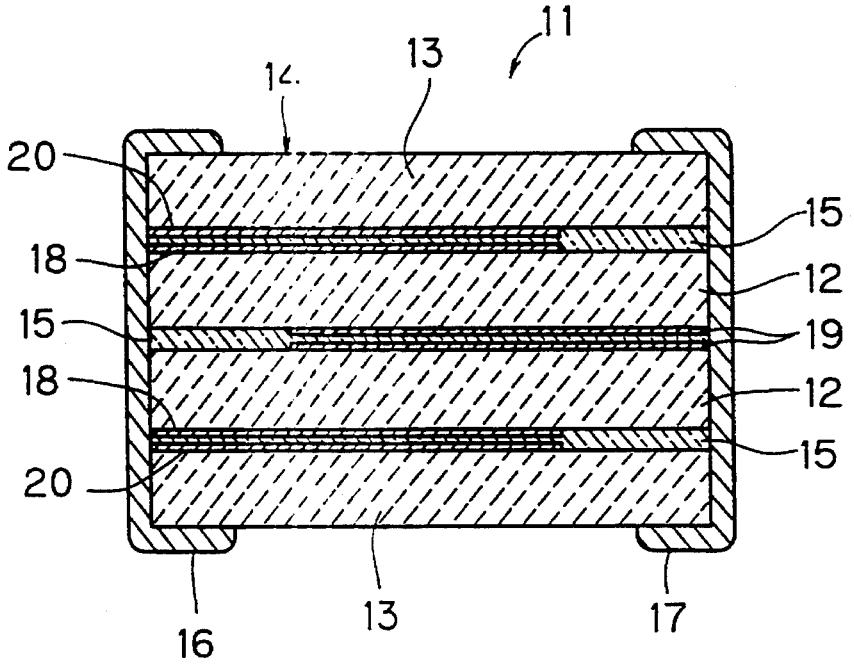
FIG. 1 is a sectional view showing a multilayer positive temperature coefficient thermistor device according to an embodiment of the present invention.

Referring to FIG. 1, a multilayer positive temperature coefficient thermistor device 11 comprises a stacked structure 14 including a plurality of semiconductor substrates 12 and 13 which are stacked with each other. The semiconductor substrates 12 and 13 are bonded to each other by glass layers 15 which are formed between the same. Each of the semiconductor substrates 12 and 13 has positive resistance-temperature coefficients, and is obtained by adding a slight amount of a rare earth element such as lanthanum, cerium, yttrium or samarium to a material which is prepared by partially replacing barium forming barium titanate with strontium for attaining a semiconductor state, and firing this material, for example. The semiconductor substrates 12 and 13 are in the form of rectangular plates, for example.

First and second terminal electrodes 16 and 17 are formed on end surfaces of the stacked structure 14, on which end surfaces of the semiconductor substrates 12 and 13 are positioned. Among the four semiconductor substrates 12 and 13 shown in FIG. 1, the semiconductor substrates 12 excluding the outermost semiconductor substrates 13 are provided thereon with first and second ohmic electrodes 18 and 19. The first and second ohmic electrodes 18 and 19 are so formed as to extend on first and second major surfaces of the semiconductor substrates 12 toward different end portions, and electrically connected to the first and second terminal electrodes 16 and 17 respectively. On the other hand, the semiconductor substrates 13 which are located on the outermost sides of the stacked structure 14 are provided with ohmic electrodes 20 only on inwardly directed major surfaces, while no ohmic electrodes are formed on outwardly directed major surfaces. Each of the ohmic electrodes 18, 19 and 20 is so formed as to extend toward one end but not to reach another end on each major surface of the semiconductor substrate 12 or 14.

Generally speaking, the directions of the plurality of semiconductor substrates 12 and 13 which are stacked with each other for obtaining the stacked structure 14 are so selected that the ohmic electrodes which are opposed to each other between adjacent ones of the semiconductor substrates are electrically connected to the same terminal electrodes 16 or 17. In more concrete terms, the ohmic electrodes 18 and 20 are opposed to each other between the outermost semiconductor substrates 13 and the semiconductor substrates 12 adjacent thereto, and both of these ohmic electrodes 18 and 20 are electrically connected to the first terminal electrode 16. On the other hand, both of the ohmic electrodes 19 which are opposed to each other between the adjacent semiconductor substrates 12 located in intermediate positions are electrically connected to the second terminal electrode 17. Thus, it is possible to completely avoid the problem of an electrical short which can be caused across adjacent ones of the semiconductor substrates 12 and 13.

As hereinabove described, the glass layers 15 which are formed between adjacent ones of the semiconductor substrates 12 and 13 are preferably formed also between the ohmic electrodes 18 and 20 and the ohmic electrodes 19 which are opposed to each other between the adjacent ones of the semiconductor substrates 12 and 13. Thus, it is possible to implement such a state that the ohmic electrodes 18, 19 and 20 are covered with the glass layers 15 respectively, thereby preventing deterioration in quality such as oxidation which can be caused in the ohmic electrodes 18, 19 and 20.

The ohmic electrodes 18, 19 and 20 contain no silver but a metal, other than silver, exhibiting an ohmic property respectively. Such a metal, other than silver, exhibiting an ohmic property can be advantageously prepared from zinc, aluminum, nickel or chromium, or an alloy thereof, for example. These ohmic electrodes 18, 19 and 20 can be formed by a method such as electroless plating, sputtering, vapor deposition or printing/baking, or a combination thereof.

The terminal electrodes 16 and 17 are also preferably made of a metal, other than silver, exhibiting an ohmic property, such as zinc, aluminum, nickel or chromium, or an alloy thereof, for example. In this case, the terminal electrodes 16 and 17 may contain a metal which is identical to or different from that contained in the ohmic electrodes 18, 19 and 20. For example, the terminal electrodes 16 and 17 and the ohmic electrodes 18, 19 and 20 may contain nickel together, or the terminal electrodes 16 and 17 may contain chromium while the ohmic electrodes 18, 19 and 20 contain nickel. The terminal electrodes 16 and 17 can be formed by a method such as electroless plating, sputtering, vapor deposition or printing/baking, or a combination thereof, similarly to the ohmic electrodes 18, 19 and 20.

In the aforementioned embodiment, the four semiconductor substrates 12 and 13 are electrically connected in parallel with each other between the terminal electrodes 16 and 17, to provide a combined resistance value of the overall positive temperature coefficient thermistor device 11. Such a combined resistance value can be arbitrarily changed by changing the number of the semiconductor substrates forming the thermistor device.

In the aforementioned embodiment, the ohmic electrodes 20 are formed only on the inwardly directed major surfaces in the semiconductor substrates 13 which are located on the outermost positions of the stacked structure 14. However, the semiconductor substrates which are located on the outermost positions may be provided with ohmic electrodes on both major surfaces, similarly to the semiconductor substrates 12. Alternatively, the semiconductor substrates which are located on the outermost positions may be provided with no ohmic electrodes. When no ohmic electrodes are formed on at least outwardly directed major surfaces of the semiconductor substrates which are located on the outermost positions, it is possible to prevent solder which is applied to the terminal electrodes in surface mounting of the thermistor device from undesirably coming into contact with the ohmic electrodes, thereby preventing an electrical short and implementing a highly reliable mounting state.

As hereinabove described, the multilayer positive temperature coefficient thermistor device 11 according to this embodiment is mainly intended for surface mounting, while the following structure may alternatively be employed in order to further advantageously carry out such surface mounting.

Figure 2:
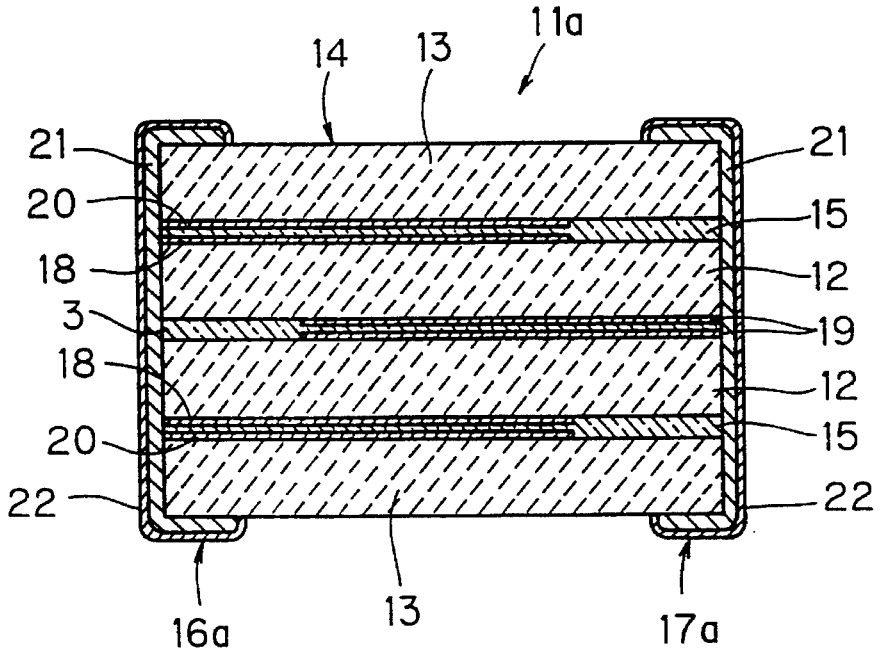
FIG. 2 is a sectional view showing a multilayer positive temperature coefficient thermistor device according to another embodiment of the present invention.
Figure 3:
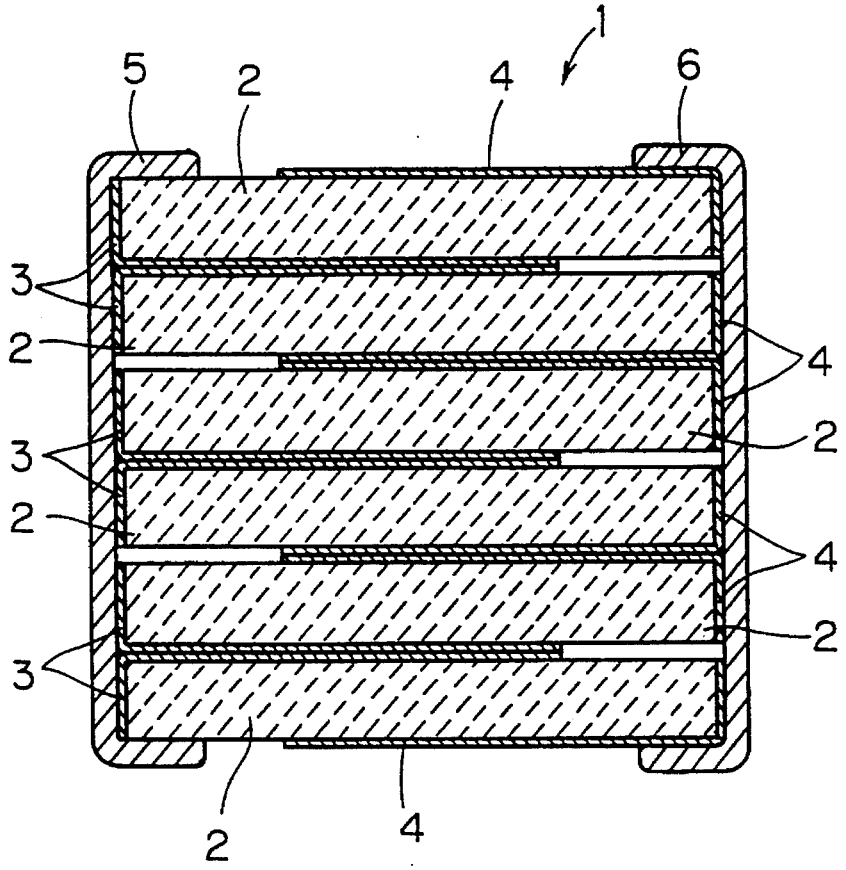
FIG. 3 PRIOR ART
FIG. 3 is a sectional view showing a conventional multilayer positive temperature coefficient thermistor device.
Figure 4:
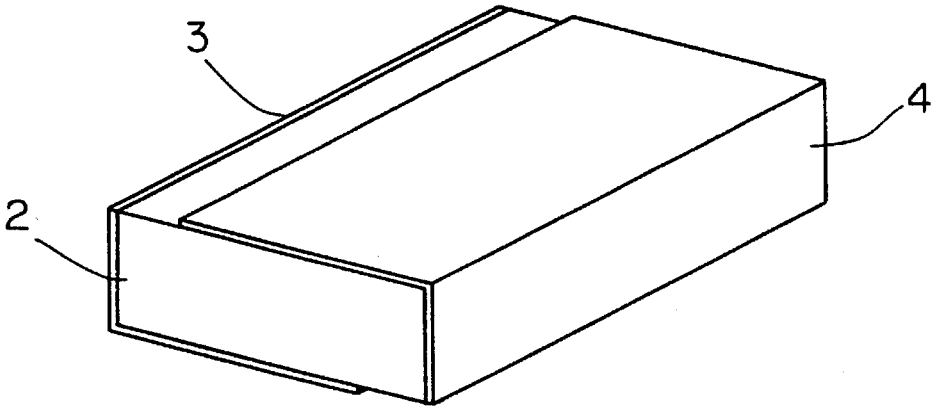
FIG. 4 PRIOR ART
FIG. 4 is a perspective view showing each semiconductor substrate included in the thermistor device shown in FIG. 3.
Figure 5:
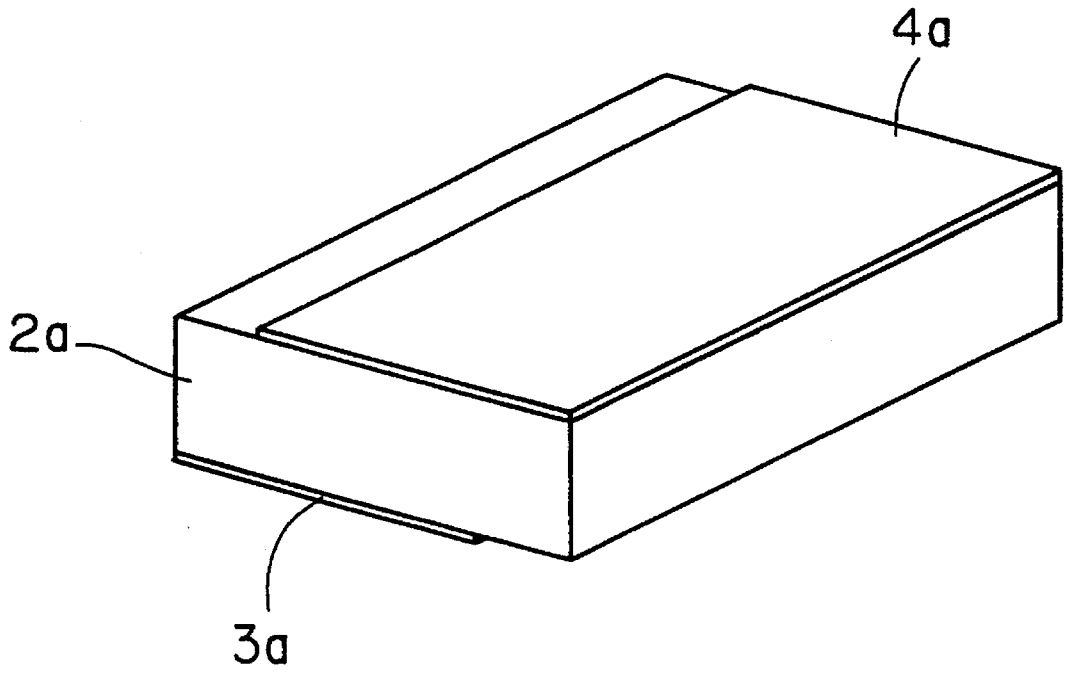
FIG. 5 PRIOR ART
FIG. 5 is a perspective view showing a semiconductor substrate which may be employed in place of the semiconductor substrate shown in FIG. 4.

FIG. 2 shows another embodiment of the present invention. Referring to FIG. 2, elements corresponding to those shown in FIG. 1 are denoted by similar reference numerals, to omit redundant description.

The feature of a multilayer positive temperature coefficient thermistor device 11*a* shown in FIG. 2 resides in structures of terminal electrodes 16*a* and 17*a*. The terminal electrodes 16*a* and 17*a* comprise underlayers 21 which are in contact with end surfaces of semiconductor substrates 12 and 13 and outermost layers 22 which are formed in the exterior of the underlayers 21 to be exposed on the surfaces. At least one intermediate layer may be formed between the underlayer 21 and the outermost layer 22.

The underlayers 21 contain a metal, other than silver, exhibiting an ohmic property, such as zinc, aluminum, nickel or chromium, or an alloy thereof, for example. Similarly to the terminal electrodes 16 and 17 shown in FIG. 1, the underlayers 21 may contain a metal which is identical to or different from that contained in ohmic electrodes 18, 19 and 20.

On the other hand, the outermost layers 22 contain a metal having excellent solderability, such as silver, tin, lead or a silver alloy, for example. The silver employed in the outermost layers 22 causes no problem of migration, dissimilarly to the above. When the outermost layers 22 contain such a metal having excellent solderability, it is possible to solder the terminal electrodes 16*a* and 17*a* to a circuit board (not shown) in excellent states in surface mounting of the thermistor device 11*a*.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A multilayer positive temperature coefficient thermistor device, including:

a stacked structure including a plurality of semiconductor substrates, having positive resistance-temperature coefficients, being stacked with each other, and a glass layer being formed between adjacent said semiconductor substrates for bonding said semiconductor substrates with each other;

first and second terminal electrodes being formed on end surfaces of said stacked structure on which end surfaces of said semiconductor substrates are positioned; and first and second ohmic electrodes being formed on first and second major surfaces of each said semiconductor substrate to extend toward different end portions, and electrically connected to said first and second terminal electrodes respectively, said ohmic electrodes containing a metal, other than silver, exhibiting an ohmic property.

2. A thermistor device in accordance with claim 1, wherein said ohmic electrodes contain a material being selected from a group of zinc, aluminum, nickel and chromium.

3. A thermistor device in accordance with claim 1, wherein said terminal electrodes contain a metal, other than silver, exhibiting an ohmic property.

4. A thermistor device in accordance with claim 3, wherein said terminal electrodes contain an element being selected from a group of zinc, aluminum, nickel and chromium.

5. A thermistor device in accordance with claim 1, wherein said terminal electrodes contain a metal being identical to that contained in said ohmic electrodes.

6. A thermistor device in accordance with claim 1, wherein said terminal electrodes contain a metal being different from that contained in said ohmic electrodes.

7. A thermistor device in accordance with claim 1, wherein said terminal electrodes include underlayers being in contact with said end surfaces of said semiconductor substrates and outermost layers being formed in the exterior of said underlayers to be exposed on surfaces.

8. A thermistor device in accordance with claim 7, wherein said underlayers contain a metal, other than silver, exhibiting an ohmic property.

9. A thermistor device in accordance with claim 8, wherein said underlayers contain an element being selected from a group of zinc, aluminum, nickel and chromium.

10. A thermistor device in accordance with claim 7, wherein said underlayers contain a metal being identical to that contained in said ohmic electrodes.

11. A thermistor device in accordance with claim 7, wherein said underlayers contain a metal being different from that contained in said ohmic electrodes.

12. A thermistor device in accordance with claim 7, wherein said outermost layers contain a metal having excellent solderability.

13. A thermistor device in accordance with claim 12, wherein said outermost layers contain an element being selected from a group of silver, tin, solder and a silver alloy.

14. A thermistor device in accordance with claim 1, wherein said glass layer is also formed between said ohmic electrodes being opposed to each other between adjacent said semiconductor substrates.

15. A thermistor device in accordance with claim 1, wherein said ohmic electrodes being opposed to each other between adjacent said semiconductor substrates are electrically connected to the same ones of said terminal electrodes.

16. A thermistor device in accordance with claim 1, wherein said stacked structure comprises second semiconductor substrates being stacked on outwardly directed major surfaces of those of said plurality of semiconductor substrates being located on respective end portions in the direction of stacking to be bonded thereto through glass layers respectively.

17. A thermistor device in accordance with claim 16, wherein said second semiconductor substrates have outwardly directed major surfaces being provided with no ohmic electrodes.

* * * * *

UNITED STATES PATENT AND TRADEMARK OFFICE

CERTIFICATE OF CORRECTION

PATENT NO. : 5,493,266
DATED : February 20, 1996
INVENTOR(S) : Kiyomi SASAKI, et al.

It is certified that error appears in the above-identified patent and that said Letters Patent is hereby corrected as shown below:

On the title page, item [73] should read

[73] Assignee: Murata Manufacturing Co., Ltd., Kyoto, Japan

Attorney, Agent or Firm — Ostrolenk, Faber, Gerb & Soffen, LLP

Signed and Sealed this

Twentieth Day of February, 2001

*Attest:*

Nicholas P. Godici

NICHOLAS P. GODICI

*Attesting Officer*

*Acting Director of the United States Patent and Trademark Office*